US005103208A

United States Patent [19]

Riordan

[11] Patent Number: 5,103,208

[45] Date of Patent: Apr. 7, 1992

[54] EXPANDABLE ENTRY DETECTION APPARATUS

[76] Inventor: Dennis E. Riordan, 2326 Sawtelle Blvd., Los Angeles, Calif. 90064

[21] Appl. No.: 628,563

[22] Filed: Dec. 17, 1990

[51] Int. Cl.[5] ..... G08B 13/02; G08B 13/13; G08B 13/22

[52] U.S. Cl. ..... 340/550; 160/10; 340/652

[58] Field of Search ..... 340/550, 652; 160/10, 160/222

[56] References Cited

U.S. PATENT DOCUMENTS

| | | | |
|---|---|---|---|
| 3,051,935 | 8/1962 | Willson | 340/550 |
| 3,713,132 | 1/1973 | Tonkowich et al. | 340/550 |
| 3,863,242 | 1/1975 | Minton | 340/550 |
| 4,146,293 | 3/1979 | Mutton et al. | 340/550 |
| 4,234,875 | 11/1980 | Williams | 340/550 |
| 4,279,288 | 7/1981 | Lanier | 160/374 |
| 4,285,383 | 8/1981 | Steenburgh | 160/374 |
| 4,293,778 | 10/1981 | Williams | 340/550 |
| 4,843,375 | 6/1989 | Riordan | 340/550 |
| 5,005,000 | 4/1991 | Riordan | 340/550 |

*Primary Examiner*—Glen R. Swann, III
*Attorney, Agent, or Firm*—W. Edward Johansen

[57] ABSTRACT

An expandable entry detection screen is for use with an electronic alarm system. The expandable entry detection screen includes a first screen frame and a second screen frame for fitting into an opening of a window frame. The second screen frame is adjustably and slidably coupled to the first screen frame. The expandable entry detection screen also includes a first screen mesh and a second screen mesh which are mechanically coupled to the first and second screen frames, respectively. A first portion of a single wire is mechanically coupled to the first and second screen meshes and disposed in the first frame. A second portion of the single wire has slack and is disposed in the second frame. The single wire is electrically coupled to the electronic alarm system. A take-up mechanism takes-up the slack in the second portion of the single wire. The take-up mechanism includes a mounting bolt and nut assembly, a spring and a hook. The mounting bolt and nut assembly is mechanically coupled to the second frame. The spring is mechanically coupled to the mounting bolt and nut assembly. The hook is mechanically coupled to the spring and to the second portion of the single wire so that the single wire remains taut in order to avoid detection by an intruder.

17 Claims, 3 Drawing Sheets

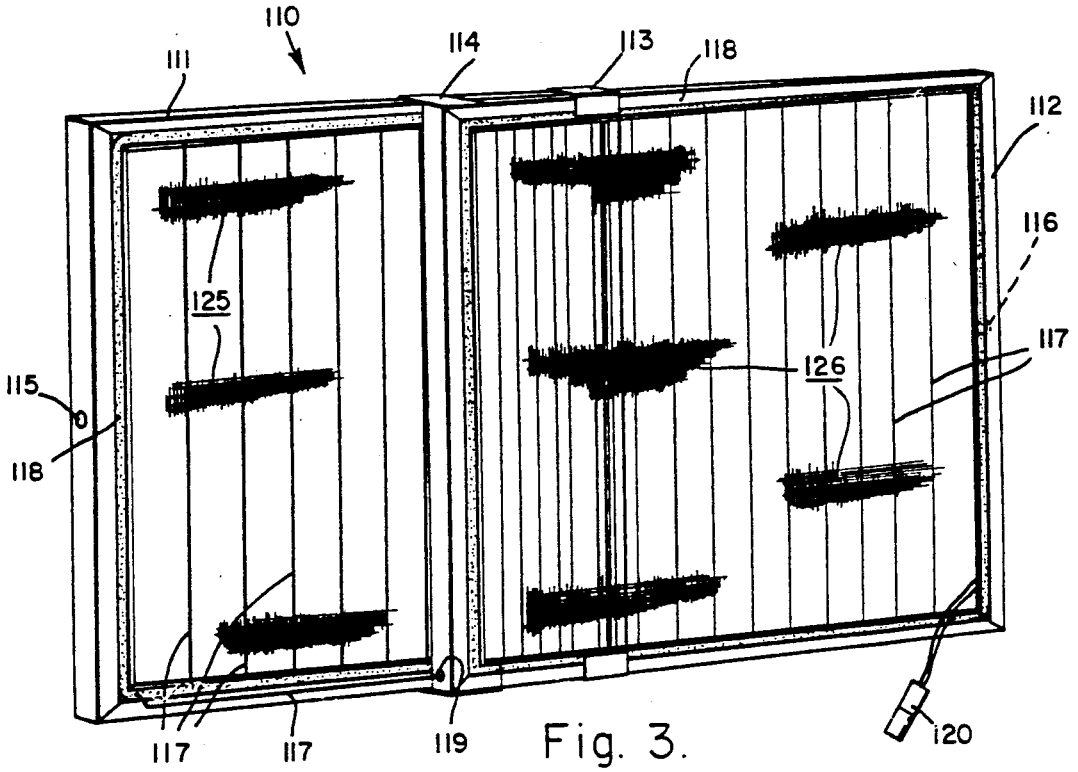
Fig. 3.
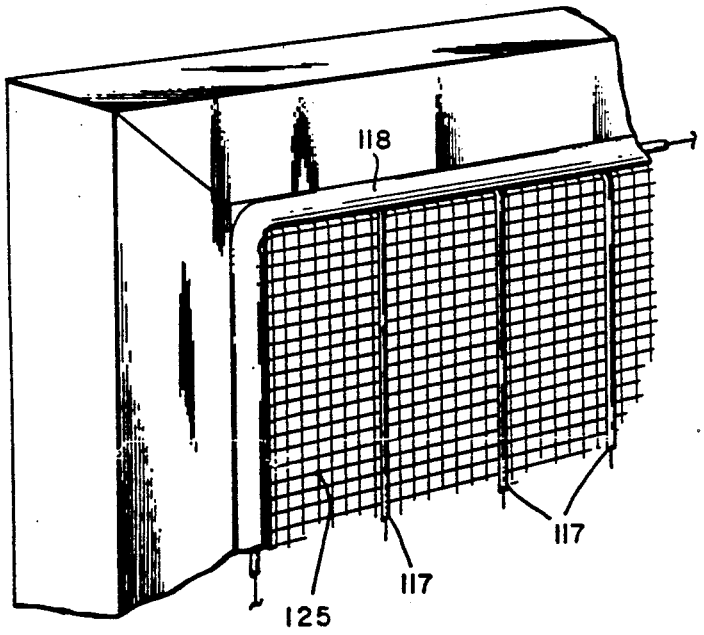
Fig. 4.
Fig. 5.
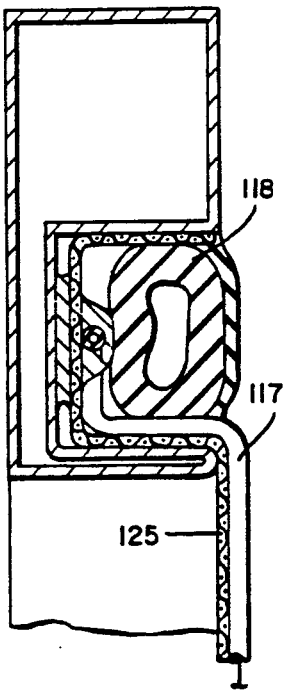

EXPANDABLE ENTRY DETECTION APPARATUS

BACKGROUND OF THE INVENTION

1. Field of the Invention

The present invention relates to an entry detection apparatus and more particularly to either a screen or a barrier bar which is not only expandable, but which also incorporates a conductive wire for connection to an alarm circuit.

2. Description of the Prior Art

U.S. Pat. No. 4,285,383, entitled Adjustable Vehicle Screen, issued to Ronald L. Steenburgh on Aug. 25, 1981, teaches an adjustable vehicle screen which utilizes a telescoping frame having a slot disposed in the innermost surface thereof so as to permit an elastic-like screen to have the marginal edge thereof pass therein. The free edges of the screen are captured within the tubular telescoping frame. The frame may be dimensional so as to accommodate various window openings in motor vehicles by allowing the screen to expand or contract in size in conformity therewith. The adjustable vehicle screen may utilize a pair of hinges joining together a pair of U-shaped frame members so as to permit the screen element to be folded up when it is not in use. Each of the U-shaped frame members has telescoping components in order to permit the adjustable vehicle screen to adjust in size for various window openings. A portion of the frame has a protrusion which extends outwardly therefrom so that the adjustable vehicle screen can be installed within the groove which is located in the frame of the vehicle in which the uppermost edge an the side edges of the window may reside. The lowermost region of the frame portion has a channel therein which receives the uppermost regions of the glass of the vehicle, when the glass window in a retracted position. The protrusion portions and the groove portion serve to maintain the frame securely in the window opening when the adjustable vehicle screen is thus installed therein.

U.S. Pat. No. 4,279,288, entitled Adjustable Frame Apparatus, issued to George C. Lacier on Jul. 21, 1981, teaches a storm window apparatus which is adjustable to fit various sizes of window and which includes a mitered right angle frame components that are hinged for easy assembly without tools. The frame members fit telescopicly within each other for adjustability.

U.S. Pat. No. 4,381,255, entitled Modular Interior Storm Window and Heat Trap, issued to Henry L. Long on Mar. 9, 1982, teaches a window insulation device for interior installation which includes at least two tubular sections, and at least one male and one female section. The male and female sections are adjustably fitted for tight reception between the window sill and the window frame.

U.S. Pat. No. 4,146,293, entitled Entry Detection Screen, issued to Robert E. Mutton and Dennis E. Riordan on Mar. 27, 1979, teaches an entry detection screen which is sometimes referred to as a protective screen which includes a screen mesh and a conductive wire. The conductive wire which may be connected to an alarm circuit is sewed onto the screen mesh in order to fix it in place. One form of the alarm circuit includes double conductive wires so that two series alarm circuits can be provided. The double conductive wires can be twisted to make the following circuit more difficult. A twist in the of the double wires can be made under a frame section where it cannot be seen by an intruder.

U.S. Pat. No. 3,051,935, entitled Protective Screen, issued to Clarence P. Wilson on Aug. 28, 1962, teaches an alarm screen which includes a frame which is to be mounted on a building enclosing structure, a sheet of non-conductive screen mesh which has its marginal portion secured to the frame and two strands of conductive wire which are spaced apart and which are interwoven in the screen mesh with each of the strands having an end portion terminating adjacent to the frame.

U.S. Pat. No. 3,495,054, entitled Supply Parts for Making Various Plug and Jack Burglar Alarm Switch Constructions, issued to Lawrence N. Lea on Feb. 10, 1970, teaches an electrical switch which is used in the normally closed protective circuit of a burglar alarm system.

U.S. Pat. No. 3,863,242, entitled Electric Screen Protection, issued to James W. Minton on Jan. 28, 1975, teaches an alarm screen frame which has projections with sharp edges which are struck out of the peripheral frame of a screen. An electrical conductor is attached to plural projections and traverses the screen, so that when a nominal physical force is exerted upon the conductor the force will cause it to break at a sharp projection. A circuit is connected to the conductor in order to actuate an alarm when the conductor is broken.

In the prior are there is a barrier bar which includes a first tubular member and a second tubular member, which is telescopically inserted in the first tubular member and which a spring resiliently biases, and which is installed in a window frame with the spring resiliently secures the barrier bar therein against the sides of the window frame. The barrier bar has a jacketed lead which is connected to an alarm system. The problem with the barrier bar is that it is possible for a potential burglar to move the barrier bar parallel to the sides of the window frame in order to enter the premises through the window frame which is to be protected by the barrier bar.

SUMMARY OF INVENTION

In view of the foregoing factors and conditions which are characteristic of the prior art it is the primary object of the present invention to provide an entry detection apparatus, such as either a screen or a barrier bar which is expandable and which also incorporates conductive wires for connection to an alarm circuit.

It is another object of the present invention to provide an expandable entry detection apparatus which is impossible for a potential burglar to move in order to enter the premises through the window frame which is to be protected by it.

It is still another object of the present invention to provide an expandable entry detection apparatus which may be installed from inside the premises.

In accordance with the present invention an embodiment of an expandable entry detection screen for use with an alarm system is described. The expandable entry detection screen includes a first screen frame and a second screen frame fit into an opening of a window frame. The second screen frame is adjustably and slidably coupled to the first screen frame. The expandable entry detection screen also includes a first screen mesh and a second screen mesh which are mechanically coupled to the first and second screen meshes, respectively. A first portion of a single wire is mechanically coupled to the first and second screen meshes and disposed in the first frame. A second portion of the single wire has slack and is disposed in the second frame. The single wire is electrically coupled to the electronic alarm system. A take-up mechanism takes-up the slack in the second portion of the single wire. The take-up mechanism includes a mounting screen and nut assembly, a spring and a hook. The mounting screen and nut assembly is mechanically coupled to the second frame. The spring is mechanically coupled to the mounting screw and nut assembly. The hook is mechanically coupled to the spring and to the second portion of the single wire so that the single wire remains taut in order to avoid detection by an intruder.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 3 is a perspective view of an expandable screen which functions as an entry detection apparatus and which has been constructed in accordance with the principles of the present invention.

FIG. 4 is a first enlarged fragmented view of the expandable screen of FIG. 3 showing a single wire which is mechanically coupled to screen mesh of the expandable screen.

FIG. 5 is an enlarged side elevational view of the expandable screen of FIG. 3 in partial cross-section showing a screen frame into which the screen mesh of FIG. 4 is mechanically coupled.

DESCRIPTION OF THE PREFERRED EMBODIMENT

Figure 1:
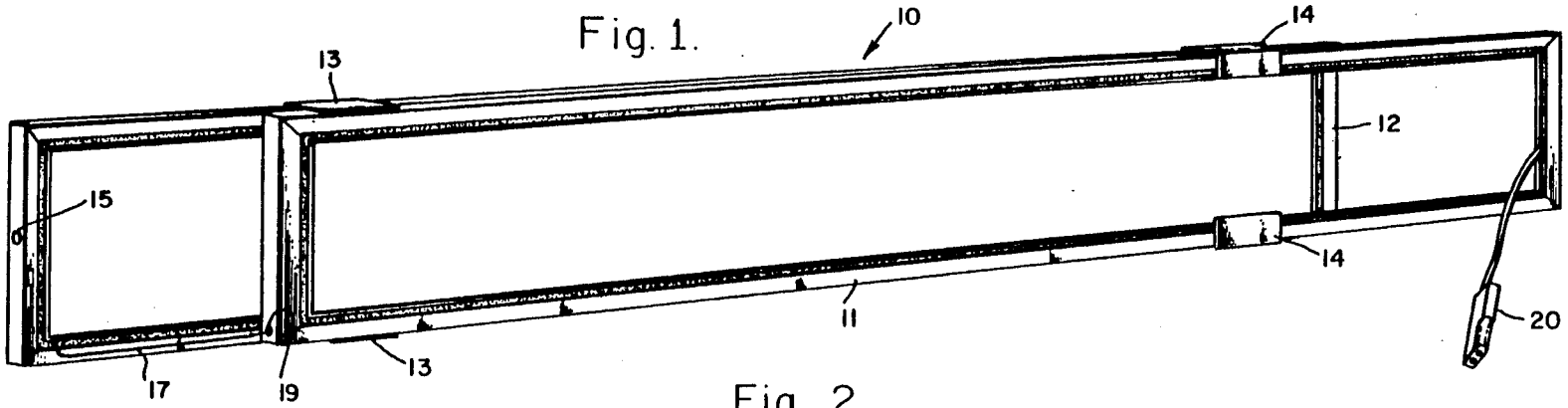
FIG. 1 is a perspective view of an expandable barrier bar which functions as an entry detection apparatus and which has been constructed in accordance with the principles of the present invention.

In order to best understand the present invention it is necessary to refer to the following description of the preferred embodiment in conjunction with the accompanying drawing. Referring to FIG. 1 an expandable barrier bar 10 for use with an electronic alarm system includes frame 11 and a second frame 12 which fit into an opening of a window frame. A first pair of brackets 13 and a second pair of brackets 14 mechanically couple the first frame 11 to the second frame 12 so that the second frame 12 is adjustably and slidably coupled to the first frame 11.

Figure 2:
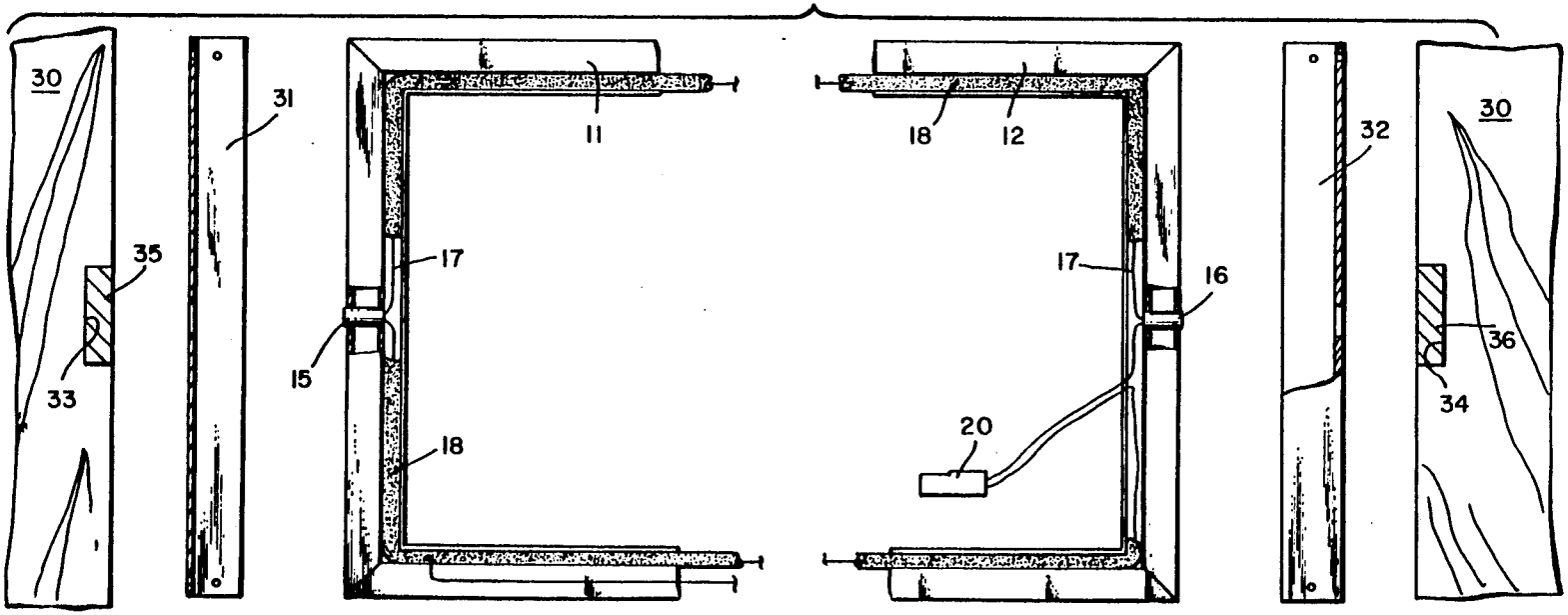
FIG. 2 is an enlarged fragmented plan view of the expandable barrier bar of FIG. 1 in partial cross-section showing the portion of an window opening into which the expandable barrier may be inserted.

Referring to FIG. 2 in conjunction with FIG. 1 the expandable entry detection barrier bar 10 also includes a first magnetic reed relay switch 15 and a second magnetic reed relay switch 16, which are disposed in the channels of the first and second frames 11 and 12 mechanically coupled to one of the first and second frames 11 and 12, respectively, and a single wire 17 which is mechanically coupled to the first and second frames 11 and 12 and which is electronically coupled to the first and second magnetic reed relay switches 15 and 16 in series. A plurality of splines 18 secures the first and second magnetic reed relay switches 15 and 16 and the single wire 17 within the channels of the first and second frames 11 and 12. There is an opening 19 in one of the sidewalls of the first frame 11 through which the single wire 17 may exit so that the single wire 17 may be mechanically coupled to the adjacent sidewall of the second frame 12. The single wire 17 is long enough do that the expandable barrier bar 10 can be either horizontally or vertically extended to either its maximum width or its maximum height. The unused portion of the single wire 17 is stored within one of the sidewalls of the first frame 11. An electrical connector 20 electrically couples the single wire 17 to and electronic alarm system.

Referring to FIG. 2 the expandable entry detection barrier bar 10 is used in combination with a frame 30 of an opening, such as a window or a door, and includes a first channel-bracket 31 and a second channel-bracket 32 which are fixedly coupled to the frame 30 and which have openings which are aligned with a first cavity 33 and a second cavity 34, respectively. A first magnet 35 and a second magnet 36 are disposed in the first and second cavities 33 and 34, respectively, and are magnetically coupled to the first and second magnet reed relay switches 15 and 16, respectively.

Referring to FIG. 3 an expandable entry detection screen 110 for use with an electronic alarm system includes a first frame 111 and a second frame 112 which fit into an opening of a window frame. A first pair of brackets 114 mechanically couple the first frame 111 to the second frame 112 so that the second frame 112 is adjustably and slidably coupled to the first frame 111.

Referring to FIG. 3 the expandable entry detection screen 110 also includes a first magnetic reed relay switch 115 and a second magnetic reed relay switch 116, which are disposed in the channels of the first and second frames 111 and 112 and mechanically coupled to one of the sidewalls of the first and second frames 111 and 112, respectively, and a single wire 117 which is mechanically coupled to the first and second magnetic reed relay switches 115 and 116 in series. A plurality of splines 118 secures the first and second magnetic reed relay switches 115 and 116 and the single wire 117 within the channels of the first and second frames 111 and 112. There is an opening 119 in one of the sidewalls of the first frame 111 through which the single wire 117 may exit so that the single wire 117 may be mechanically coupled to the adjacent sidewall of the second frame 112. The single wire 117 is long enough so that the expandable screen 110 can be either horizontally or vertically extended to either its maximum width or its maximum height. The unused portion of the single wire 117 is stored within one of the sidewalls of the first frame 111. An electrical connector 120 electrically couples the single wire 117 to an electronic alarm system. In an alternative embodiment the single wire 117 may be replaced with a optical fiber which is mechanically coupled to the first and second screen frames 111 and 112 and which is optically coupled to a optical alarm system.

Still referring to FIG. 3 the expandable entry detection barrier bar 10 also includes a first screen mesh 125 and a second screen mesh 126 which are mechanically coupled to the first and second screen frames 111 and 112, respectively. The single wire 117 is mechanically coupled to the first and second screen meshes 125 and 126.

An optical waveguide may be used in an entry detection screen which includes a screen frame which fits into an opening of a window frame and a screen mesh which is mechanically coupled to the screen frame. The entry detection screen also includes an optical fiber which is mechanically coupled to the screen mesh and which is optically coupled to an optical alarm system. An optical fiber may replace the single wire in the expandable entry detection screen 110. In the preferred embodiment of the expandable entry detection screen 110 either the single wire 117 or the optical fiber is sewn to the first and second meshes 125 and 126. In another embodiment of the expandable entry detection screen 110 either the single wire 117 or the optical fiber is interwoven into the first and second meshes 125 and 126. In still another embodiment of the expandable entry detection screen 110 either the single wire 117 or the optical fiber is glued by cement to the first and second meshes 125 and 126. In yet another embodiment of the expandable entry detection screen 110 either the single wire 117 or the optical fiber is not only interwoven into the first and second meshes 125 and 126, but is also glued by cement and/or sewed to the first and second screen meshes 125 and 126

Referring to FIG. 3 in conjunction with FIG. 4 and FIG. 5, the first and second screen meshes 125 and 126 are mechanically coupled to the first and second screen frames 111 and 112, respectively, each of which has four sidewalls. Each sidewall has a channel into which a spline 118 is placed on top of the peripheral edge of the screen mesh 125 or 126. A bonding cement may be placed in the channel so that the bonding cement seeps through the screen mesh 125 or 126 and envelopes either the single wire 117 or the optical fiber which is laying in the channel. The bonding cement also secures the spline 118 within the channel thereby increasing the security of the entry detection screen 110. An all weather bonding is placed on top of each spline 118 to provide environmental protection for outdoor screens.

Figure 6:
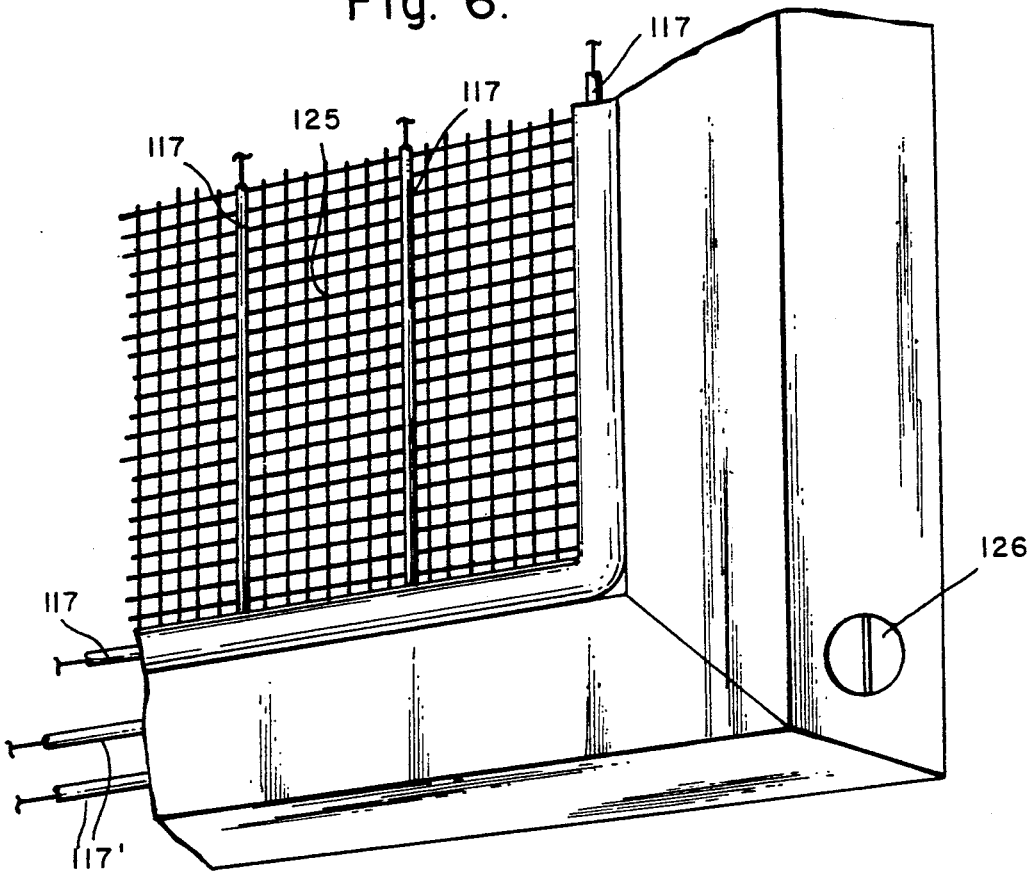
FIG. 6 is a second enlarged fragmented view of the expandable screen of FIG. 3 showing three parts of the single wire and a take-up mechanism which takes up the slack in the single wire.
Figure 7:
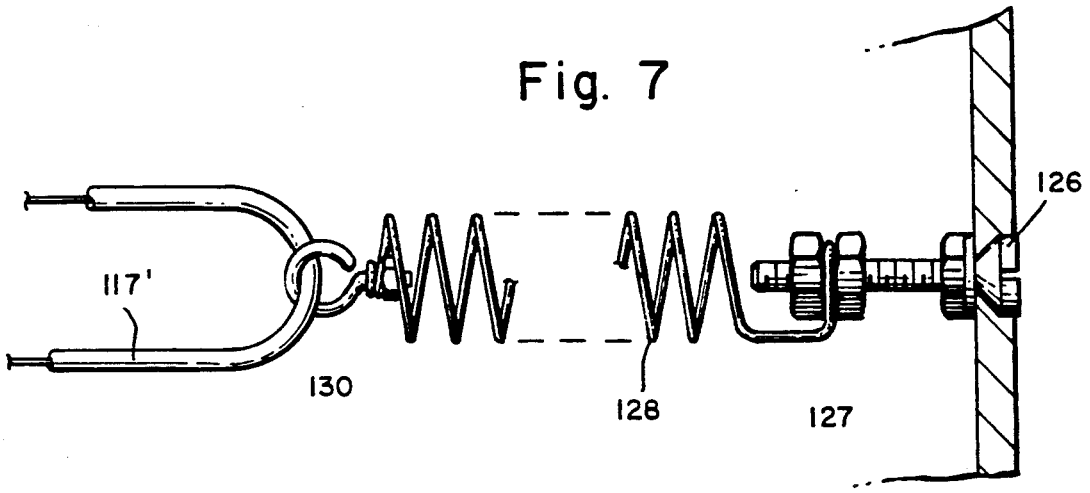
FIG. 7 is an elevational view of the take-up mechanism of FIG. 6.

Referring to FIG. 6 in conjunction with FIG. 7 a first portion of the single wire 117 is mechanically coupled to the second screen mesh 125 and a second portion of the single wire 117' is disposed within the frame and is mechanically coupled to a take-up mechanism 127 which includes a mounting bolt and nut assembly 126, a spring 128 and a hook 130. The take-up mechanism 127 takes up the slack in the second portion of the single wire 117'.

From the foregoing it can be seen that an expandable entry detection barrier bar and an expandable entry detection screen have been described.

What is claimed is:

1. An expandable entry detection screen for use with an electronic alarm system, said expandable entry detection screen comprising:

a. a first screen frame which fits into an opening of a window frame b. a second screen frame which fits into said opening of said window frame and which is adjustably and slidably coupled to said first screen frame;

c. a first screen mesh which is mechanically coupled to said first screen frame;

d. a second screen mesh which is mechanically coupled to said second screen frame;

e. a single wire, a first portion of which is mechanically coupled to said first and second screen meshes and disposed in said first frame and a second portion of which has slack and which is disposed in said second frame, said single wire being electrically coupled to the electronic alarm system; and f. taking-up means for taking-up slack in said second portion of said single wire, said taking-up means including a mounting bolt and nut assembly which is mechanically coupled to said second frame, a spring which is mechanically coupled to said mounting bolt and nut assembly and a hook which is mechanically coupled to said spring and to said second portion of said single wire so that said single wire remains taut in order to avoid detection by an intruder.

2. An expandable entry detection screen according to claim 1 wherein said single wire is sewn to said first and second screen meshes.

3. An expandable entry detection screen according to claim 2 wherein said single wire is also glued to said first and second screen meshes.

4. An expandable entry detection screen according to claim 1 wherein said single wire is interwoven into said first and second screen meshes.

5. An expandable entry detection screen according to claim 4 wherein said single wire is also sewn to said first and second screen meshes.

6. An expandable entry detection screen according to claim 5 wherein said single wire is also glued to said first and second screen meshes.

7. An expandable entry detection screen according to claim 4 wherein said single wire is also glued to said first and second screen meshes.

8. An expandable entry detection screen according to claim 1 wherein said single wire is glued to said first and second screen meshes.

9. An expandable entry detection barrier bar for use with an electronic alarm system, said expandable entry detection barrier bar comprising:

a. a first frame which fits into an opening of a window frame;

b. a second frame which fits into said opening of said window frame and which is adjustably and slidably coupled to said first frame; and c. a single wire, a first portion of which is disposed in said first frame and a second portion of which has slack and which is disposed in said second frame, said single wire being electrically coupled to the electronic alarm system; and d. taking-up means for taking-up slack in said second portion of said single wire, said taking-up means including a mounting bolt and nut assembly which is mechanically coupled to said second frame, a spring which is mechanically coupled to said mounting bolt and nut assembly and a hook which is mechanically coupled to said spring and to said second portion of said single wire so that said single wire remains taut in order to avoid detection by an intruder.

10. An expandable entry detection screen for use with an optical alarm system, said expandable entry detection screen comprising;

a. a first screen frame which fits into an opening of a window frame;

b. a second screen frame which fits into said opening of said window frame and which is adjustably and slidably coupled to said first screen frame;

c. a first screen mesh which is mechanically coupled to said first screen frame;

d. a second screen mesh which is mechanically coupled to a second screen frame;

e. an optical fiber, a first portion of which is mechanically coupled to said first and second screen meshes and which is disposed in said first frame and a second portion of which has slack and which is disposed in said second frame, said optical fiber being optically coupled to the optical alarm system; and d. taking-up means for taking-up slack in said second portion of said optical fiber, said taking-up means including a mounting bolt and nut assembly which is mechanically coupled to said second frame, a spring which is mechanically coupled to said mounting bolt and nut assembly and a hook which is mechanically coupled to said spring and to said second portion of said optical fiber so that said optical fiber remains taut in order to avoid detection by an intruder.

11. An expandable entry detections screen according to claim 3 wherein said optical fiber is sewn to said first and second screen meshes.

12. An expandable entry detection screen according to claim 11 wherein said optical fiber is also glued to said first and second screen meshes.

13. An expandable entry detection screen according to claim 11 wherein said optical fiber is also glued to said first and second screen meshes.

14. An expandable entry detection screen according to claim 10 wherein said optical fiber is interwoven into said first and second screen meshes.

15. An expandable entry detection screen according to claim 12 wherein said optical fiber is also sewn to said first and second screen meshes.

16. An expandable entry detection screen according to claim 15 wherein said optical fiber is also glued to said first and second screen meshes.

17. An expandable entry detection screen according to claim 10 wherein said optical fiber is glued to said first and second screen meshes.

* * * * *